US012612573B1

(12) United States Patent
McDonald et al.

(10) Patent No.: US 12,612,573 B1
(45) Date of Patent: Apr. 28, 2026

(54) HYDROXYL FUNCTIONAL FLUORINATED MONOMERS AS COMBUSTION AIDS FOR SOLID FUEL RAMJET FUELS

(71) Applicants: Brian A. McDonald, Taft, TN (US); Jeremy R. Rice, Huntsville, AL (US); Terry Pruett, Elora, TN (US); Jason Wachs, Redstone Arsenal, AL (US); Kenneth Lawrence Pledger, Huntsville, AL (US); Wayne Steelman, Hazel Green, AL (US); Christopher Allen Marshall, New Market, AL (US); Tony Drew Vinson, Moulton, AL (US); Dan Jones, Prairie Village, KS (US); Brian Hayes, Rockford, MI (US)

(72) Inventors: Brian A. McDonald, Taft, TN (US); Jeremy R. Rice, Huntsville, AL (US); Terry Pruett, Elora, TN (US); Jason Wachs, Redstone Arsenal, AL (US); Kenneth Lawrence Pledger, Huntsville, AL (US); Wayne Steelman, Hazel Green, AL (US); Christopher Allen Marshall, New Market, AL (US); Tony Drew Vinson, Moulton, AL (US); Dan Jones, Prairie Village, KS (US); Brian Hayes, Rockford, MI (US)

( * ) Notice: Subject to any disclaimer, the term of this patent is extended or adjusted under 35 U.S.C. 154(b) by 0 days.

(21) Appl. No.: 19/034,750

(22) Filed: Jan. 23, 2025

(51) Int. Cl.
*C10L 9/12* (2006.01)

(52) U.S. Cl.
CPC ..... *C10L 9/12* (2013.01); *C10L 2200/0218* (2013.01); *C10L 2270/04* (2013.01)

(58) Field of Classification Search
CPC . C10L 9/12; C10L 2200/0218; C10L 2270/04
See application file for complete search history.

(56) References Cited

U.S. PATENT DOCUMENTS 10,591,950 B2 3/2020 McDonald
2023/0093642 A1* 3/2023 Swanson ..... F42B 15/10 60/219

FOREIGN PATENT DOCUMENTS

CN 111170816 A * 5/2020 ..... C06B 33/06
CN 112814807 A * 5/2021 ..... F02K 1/80

OTHER PUBLICATIONS

B. A. McDonald and J. Rice, "Solid fuel ramjet fuel optimization for maximum impulse-density with respect to air to fuel ratio and relative fuel regression tes derived from thermogravimetric analysis," Aerospace Science and Technology, vol. 86, pp. 478-486, 2019.
B. McDonald and J. Rice, "Solid fuel ramjet fuel optimization for maximum thrust to drag ratio and impulse density subject to geometric restraints on missile (continued below)outer mold line," Aerospace Science and Technology, p. 75, 2018.

(Continued)

*Primary Examiner* — Latosha Hines

(57) ABSTRACT

The application relates to a SFRJ fuel comprising metallic particles selected from the group consisting of boron carbide and aluminum particles; the metallic particles being encapsulated in a fluorinated coating which aids in combustion; wherein the fluorinated coating is selected from the group consisting of 1,1,1,3,3,3 hexafluoro-2-propanol, 2,2,2 trifluoroethanol, and 3-hydroxybenzotrifluoride.

2 Claims, 7 Drawing Sheets

(56) References Cited

OTHER PUBLICATIONS

B.A. McDonald, J. Rice and J. Stewart, "Mechanical and thermodynamic characteristics of a copolymer of LP-33 polysulfide and hydroxyl terminated polybutadiene for solid fuel ramjet applications, "Combustion and Flame, vol. 184, pp. 11-19, 2017.
B. McDonald, R. Rice, B. Hayes, C. Marshall, L. Pledger, D. Myers and D. Jones, "High density solid fuel ramjet fuel based on 1,6-hexanediol diglycidyl ether and methyltetrahydrophtha.kc anhydride," Fuel, vol. 278, p. 118354, 2020.

* cited by examiner

| | |
|---|---|
| 3A | HDGE_Al(40%) |
| 3B | HDGE_PTFE_Al(40%) |
| 3C | HDGE_TFE_Al(40%) |
| 3D | HDGE_HBTF_Al(40%) |
| 3E | HDGE_$HF_2P$_Al(40%) |

FIG. 3c

| | |
|---|---|
| | C* Efficiency |
| | Pressure Integral / unit volume of fuel |
| 4A | 605_$HF_2P$_AL(25%) |
| 4B | 605_HBTF_AL(25%) |
| 4C | 605_AL(25%) |

FIG. 4b

HYDROXYL FUNCTIONAL FLUORINATED MONOMERS AS COMBUSTION AIDS FOR SOLID FUEL RAMJET FUELS

BACKGROUND

Research into solid fuel ramjet fuel (SFRJ) development activities has included the exploration of various polymers and metal performance additives. Historically, there have been problems with metal combustion in SFRJ.

BRIEF DESCRIPTION OF THE DRAWINGS

FIG. 3*c* is a key to the 3A-3E formulations shown in FIGS. 3*a* and 3*b*.

FIG. 4*b* is a key to the symbols shown in FIG. 4*a*.

DETAILED DESCRIPTION

Figure 1A:
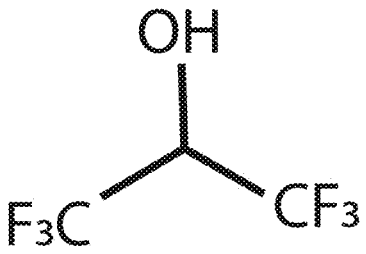
FIG. 1*a* is the molecular structure of 1,1,1,3,3,3-hexafluoro-2-propanol ($HF_2P$).

The objective of the application is to encapsulate metallic particles in SFRJ fuel grain, the encapsulation being within a fluorinated coating that is available for combustion.

Fluorinated monomer materials, such as FHCA, i.e., $HF_2P$, TFE, and HBTF, which have reactive hydroxyl functionality, were incorporated as combustion aids encapsulating metallic particles: boron carbide and aluminum, contained in SFRJ fuel grain.

In the present application, fluorinated monomer materials having reactive hydroxyl functionality were investigated as combustion aids for boron carbide, aluminum particles, and amorphous boron contained within a SFRJ fuel grain. The FHCA were chosen from a larger group of fluorinated monomers because of their hydroxyl functionality, high density relative to the polymer, and their fuel value. One of the objectives of this application was to encapsulate the metallic particles within a fluorinated coating that is available for combustion without the inclusion of additional particulates, such as PTFE. Inclusion of the metallic particles into the uncured matrix fully wets all surfaces prior to gelation.

The applicants chose not to include particles such as PTFE. Fluorinated materials such as PTFE have shown promise in previous studies. This has resulted in the predominance of PTFE in these applications. However, PTFE is a stable material up to approximately 600° C. and is incorporated as a powder. Thus, for the fluorine to become available to react with metals, the PTFE must be heated and decomposed from its particle form.

Test data have shown that these FHCA materials can liberate fluorinated gaseous species at temperatures considerably lower than the decomposition and auto ignition temperatures of common combustion aids, e.g., PTFE or magnesium. The materials were incorporated into the polymer matrix by pre-reacting the hydroxyl functional groups of the FHCA with either oxiranes along the polymer backbone, or by pre-reacting the groups with an anhydride curative.

The merits of the FHCA have been investigated through a series of tests that include TGA, DSC, scanning electron microscopy (SEM), and a series of fuel grain combustion tests. While the work focuses on the combustion of FHCA with metal particles, such as boron carbide and aluminum, the results are also applicable to amorphous boron, given the similar combustion mechanisms.

The results of the work showed that the FHCA improve the characteristic exhaust velocity efficiency by as much as 4 percentage points over a base line formulation containing 40% aluminum. The TGA and DSC analyses showed that the FHCA have been reacted successfully into the polymer matrix and accelerated decomposition out to 360° C. at a rate that correlated to their mass fraction within the formulation. (See FIGS. 2A and 2B.) These analyses also showed that the FHCA depolymerize prior to the primary mass loss temperature of the fuel matrix, indicating that the FHCA is available in the gaseous phase through the boundary layer of the SFRJ fuel grain as the preheating of the metal particle occurs.

Figure 1B:
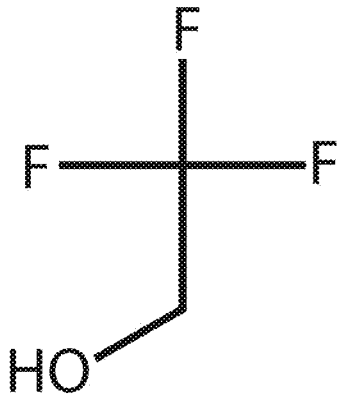
FIG. 1*b* is the molecular structure of 2,2,2-trifluoroethanol (TFE).
Figure 1C:
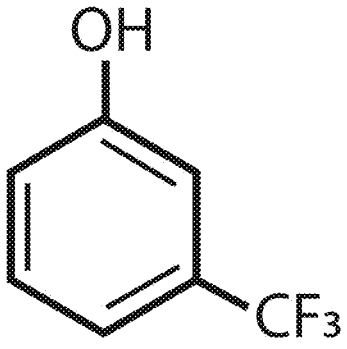
FIG. 1*c* is the molecular structure of 3-hydroxybenzotrifluoride (HBTF).

The FHCA considered within the present application as candidate combustion aids include two aliphatic alcohols and one phenol, the structures of which are shown in FIG. 1*a*, FIG. 1*b* and FIG. 1*c*. Shown is 1,1,1,3,3,3 hexafluoro-2-propanol ($HF_2P$), a secondary alcohol; 2,2,2 trifluoroethanol (TFE), a primary alcohol; and 3-hydroxybenzotrifluoride (HBTF), a phenol.

The pertinent physical properties of each material are shown in Table 1.

TABLE 1

| Properties | hexafluoro-2-propanol | trifluoroethanol | 3-hydroxybenzo-trifluoride |
|---|---|---|---|
| Density (g/cc) | 1.60 | 1.39 | 1.33 |
| Molecular Weight (g/mole) | 168.04 | 100.3 | 162 |
| Boiling Point (° C.) | 59 | 78 | 178 |
| Fluorine Mass Fraction (%) | 67.8 | 56.8 | 35.2 |
| OH Eq. Weight (g/Eq.) | 168.04 | 100.3 | 162 |
| Fuel Grain Mass Fraction (%) | 6.8 | 8.1 | 13.1 |

Figure 2A:
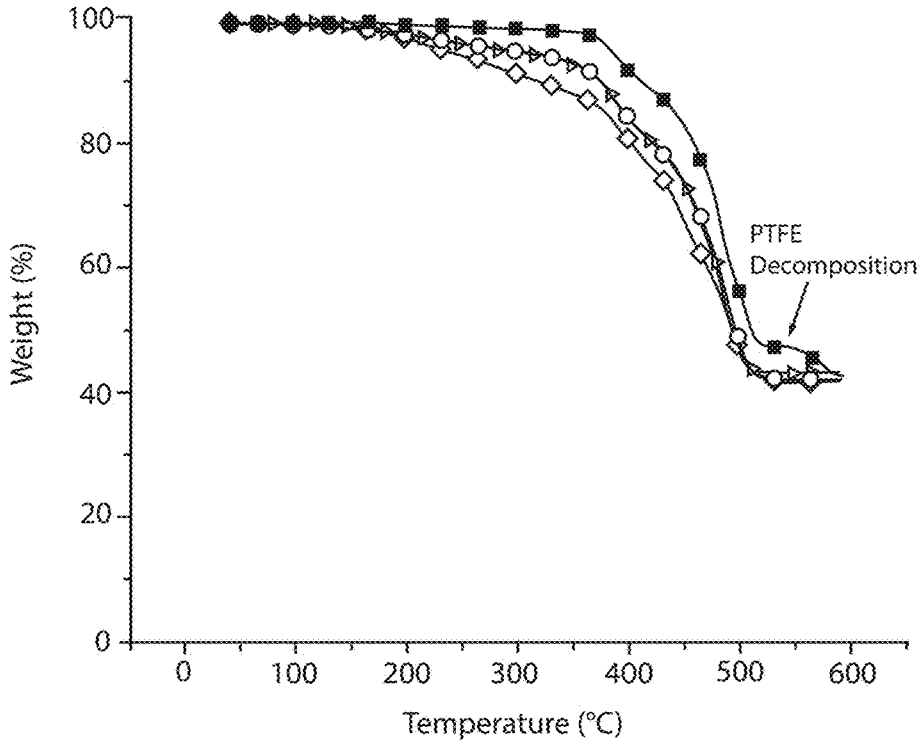
FIG. 2*a* shows the Thermogravimetric Analysis (TGA) Differential Scanning calorimetry (DSC) weight versus temperature results for fuel samples of 605-40% $B_4C$ ((i.e., PolyBD 605E, the commercial name for an epoxidized polybutadiene, hexanediol diglycidyl ether) with various combustion aids.
Figure 2B:
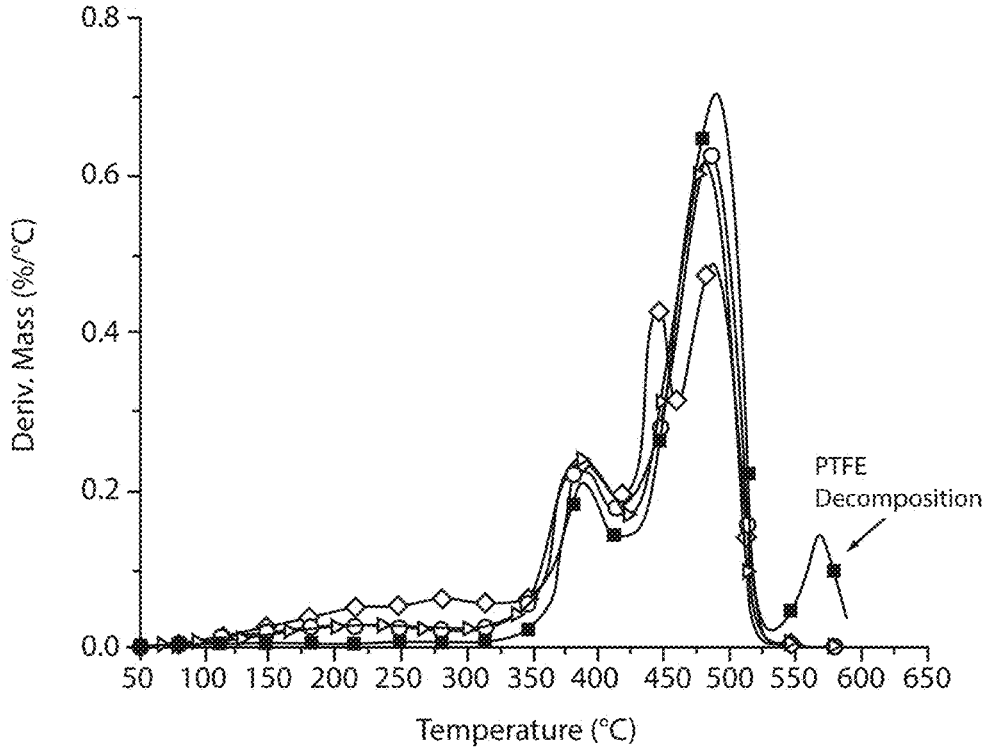
FIG. 2*b* shows the TGA DSC derivative mass loss versus temperature for fuel samples of 605-40% B4C ((i.e., poly BC 605E, the commercial name for an epoxidized polybutadiene, hexane diol diglycidyl ether) with various combustion aids.

FIGS. 2*a* and 2*b*, respectively, show TGA weight and derivative mass loss versus temperature for formulations of $B_4C$ with the FHCA compositions of the present application plus a formulation of $B_4C$ with PTFE as shown in Table 1. The effect of the FHCA on the decomposition rates was very apparent. The ranking of the rates from fast to slow follows the ranking of total mass fraction of the FHCA in the formulation from highest to lowest. These graphs show the effect of the decomposition rate of the material as a function of the mass fraction of the FHCA.

Figure 2C:
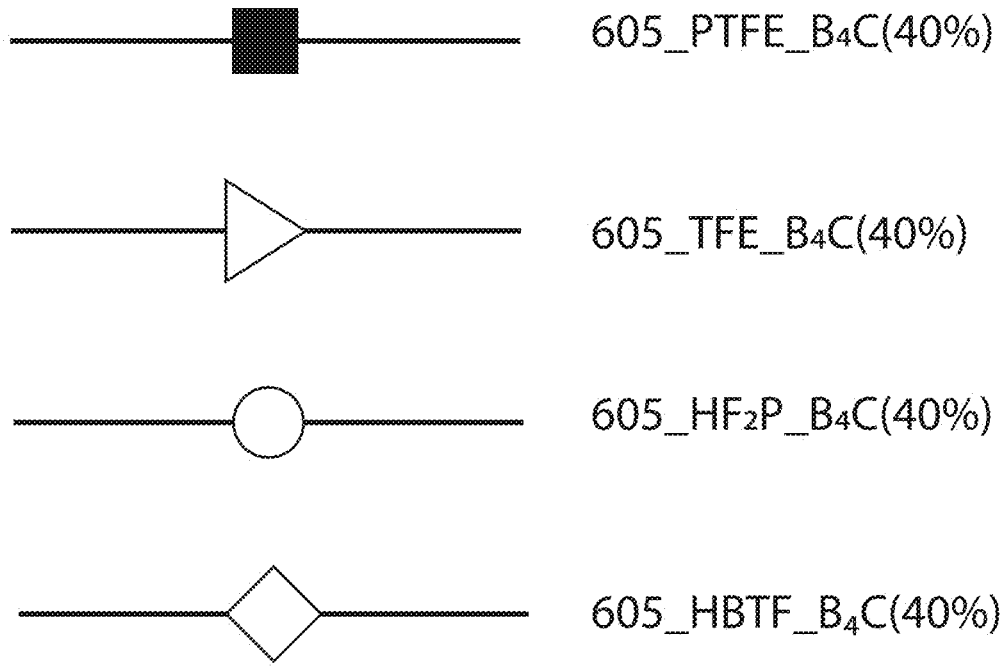
FIG. 2*c* is a key to the symbols in FIGS. 2*a* and 2*b*.

FIG. 2*c* is a key to the symbols in FIGS. 2*a* and 2*b*.

Figure 3A:
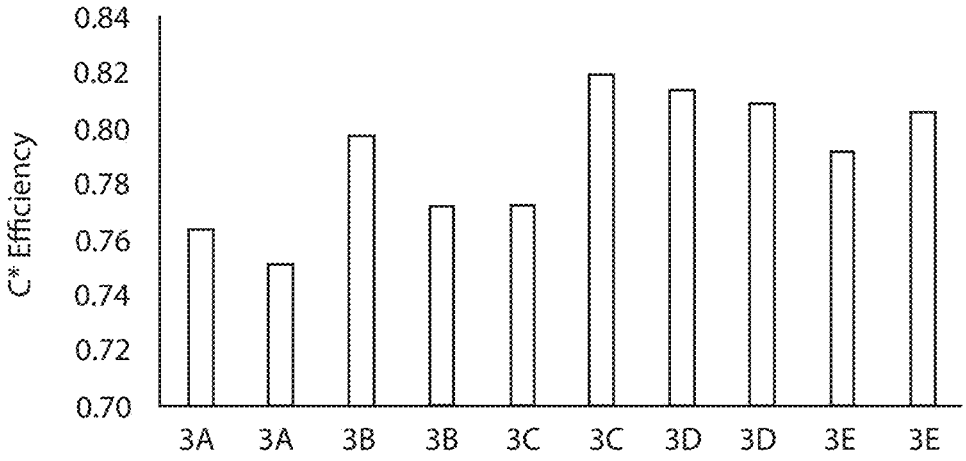
FIG. 3*a* shows a graph comparing the Characteristic Exhaust Velocity (C*) Efficiency of fluorinated hydroxyl functional combustion aids (FHCA) and Al using 1,6-hexanediol diglycidyl ether (HDGE) formulations of the FHCA and Al.

FIG. 3*a* shows the characteristic exhaust velocity (C*) efficiency which is the ratio of the delivered C* to the theoretical C* at an equivalent pressure, equivalence ratio, and initial fuel/air mixture temperature.

Figure 3B:
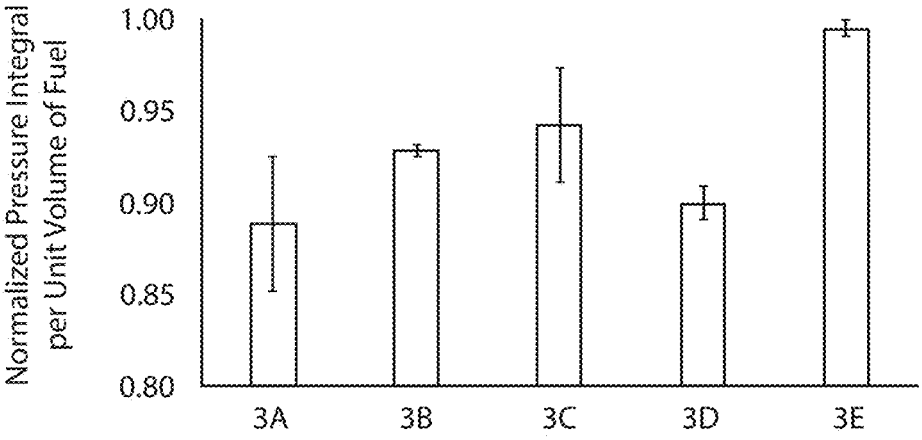
FIG. 3*b* shows a graph comparing Normalized Pressure Integral Density of various FHCA monomers and Al using HDGE formulations of the FHCA and Al.

FIG. 3*b* shows the normalized chamber pressure integral per unit volume of fuel or pressure integral density for the replicate averages of each formulation. The pressure integral per unit volume was proportional to the impulse density of the fuel.

FIG. 3*c* is a key to the 3A-3E formulations shown in FIGS. 3*a* and 3*b*.

Figure 4A:
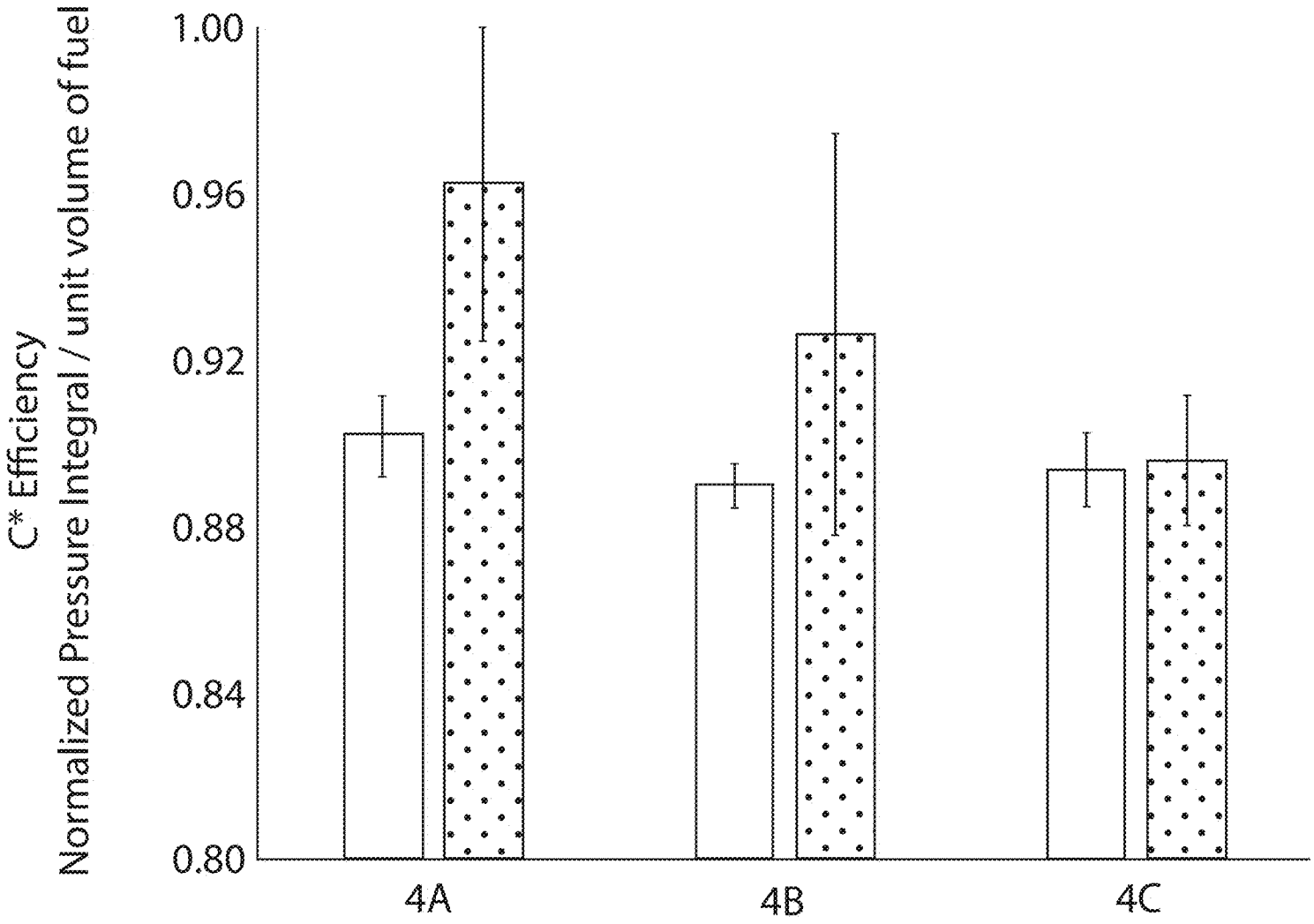
FIG. 4*a* shows a graph comparing Efficiency and Normalized Pressure Integral per unit volume of fuel for HDGE formulations of 25% Al with $HF_2P$ and HBTF, respectively, as well as HDGE formulations with 25% Al alone.

In FIG. 4*a*, comparisons of efficiency and normalized pressure were made with HDGE formulations containing FHCA compositions: which included HBTF and $HF_2P$, with 25% Al, along with an HDGE formulation with 25% Al alone for comparison to a baseline. HDGE was used as a carrier in order to test the FHCA and Al samples.

FIG. 4*b* is a key to the symbols shown in FIG. 4*a*.

One of the embodiments of this application is the method of using fluorinated hydroxy functional combustion aids (FHCA) in SFRJ fuels to encapsulate metallic particles within a fluorinated coating to improve exhaust velocity efficiency up to 4 percent, comprising adding FHCA to SFRJ fuel comprising a polymer matrix to molecularly distribute and immobilize the FHCA in the polymer matrix, the ramjet fuel including metallic particles selected from the group consisting of boron carbide, aluminum particles, and amorphous boron, the FHCA selected from the group consisting of 1,1,1,3,3,3 hexafluoro-2-propanol, 2,2,2 trifluoroethanol, and 3-hydroxybenzotrifluoride; and encapsulating the metallic particles in the distributed and immobilized FHCA.

In one embodiment, the application relates to the method of using FHCA in SFRJ, wherein in a pre-reaction step before adding the FHCA to the polymer matrix, hydroxyl functional groups of the FHCA are pre-reacted with reagents selected from the group consisting of oxiranes and anhydride curatives In an additional embodiment, the application relates to the method of using FHCA in SFRJ fuel, wherein the metallic particles do not include PTFE.

Another embodiment of this application is the method of making SFRJ fuel with encapsulated metallic particles comprising: adding FHCA to the SFRJ fuel comprising a polymer matrix to molecularly distribute and immobilize the FHCA in the polymer matrix, the ramjet fuel including metallic particles selected from the group consisting of boron carbide, aluminum particles, and amorphous born, the FHCA selected from the group consisting of 1,1,1,3,3,3 hexafluoro-2-propanol, 2,2,2 trifluoroethanol, and 3-hydroxybenzotrifluoride; encapsulating the metallic particles in the distributed and immobilized FHCA.

In one embodiment, the application relates to the method of making SFRJ fuel with encapsulated metallic particles in solid fuel ramjet fuel, wherein in a pre-reaction step before adding the FHCA to the polymer matrix, hydroxyl functional groups of the FHCA are pre-reacted with reagents selected from the group consisting of oxiranes and anhydride curatives.

In an additional embodiment, the application relates to the method of making SFRJ fuel with encapsulated metallic particles, wherein the metallic particles do not include PTFE.

Yet another application relates to SFRJ fuel comprising a polymer matrix and metallic particles selected from the group consisting of boron carbide, aluminum particles and amorphous boron; the metallic particles being encapsulated in fluorinated hydroxy functional combustion aids (FHCA) which aids in combustion; wherein the FHCA is selected from the group consisting of 1,1,1,3,3,3 hexafluoro-2-propanol, 2,2,2 trifluoroethanol, and 3-hydroxybenzotrifluoride; and wherein the FHCA is molecularly distributed and immobilized in the polymer matrix of the Ramjet solid fuel.

In one embodiment, the application relates to the SFRJ solid fuel comprising a polymer matrix, wherein the FHCA is molecularly distributed and immobilized in the polymer matrix after the FHCA is pre-reacted with reagents selected from the group consisting of oxiranes and anhydride curatives.

In an additional embodiment, the application relates to SFRJ solid fuel wherein the metallic particles do not include PTFE.

To verify these methods and configurations, the following experiments were conducted and described in the Examples below.

EXAMPLES

Example 1

An investigation was made to find an alternative approach for the incorporation of fluorine in SFRJ. The investigation was performed by mixing fluorinated materials into the SFRJ polymer matrix, the fluorinated monomer materials having reactive functional groups. These materials were distributed throughout the fuel matrix on the molecular level yet bound to the fuel matrix polymers via a linking reaction. The work focused on fluorinated monomer materials having reactive hydroxyl functionality. These fluorinated monomer materials, i.e. the FHCA: 1,1,1,3,3,3-hexafluoro-2-propanol, 2,2,2-trifluoroethanol, and 3-hydroxy-benzotrifluoride. They were chosen because of their hydroxyl functionality, high density relative to the polymer, and their fuel value.

The materials, 1,1,1,3,3,3-hexafluoro-2-propanol, 2,2,2-trifluoroethanol, and 3-hydroxy-benzotrifluoride, were incorporated into the SFRJ polymer matrix by pre-reacting the hydroxyl functional groups of the FHCA with either oxiranes along the polymer backbone, or pre-reaction to an anhydride curative. In either case, the materials and thus fluorine, were molecularly distributed throughout the fuel matrix and were immobilized via the reactions. Two base polymers (HDGE and epoxidized polybutadiene HDGE) were considered, the polymers having oxygen contents that differ by approximately 50%. In all formulations, the metal to elemental fluorine mass ratio was held constant at 8.7:1, or 4.6% fluorine for a 40% metal loaded matrix. The merits of the FHCA were investigated through a series of tests that include TGA, DSC, scanning microscopy (SEM), and a series of 51 mm×152 mm and 51 mm×305 mm fuel grain combustion tests. While the work focuses on $B_4C$ and aluminum, the results are applicable to amorphous boron, given the similar combustion mechanisms as described above. Both combustion mechanisms require the removal of oxide coatings to achieve particle ignition.

Example 2

Several other materials, besides the FHCA's, were investigated prior to selection of those presented herein. An emulsion of perfluoropolyether produced excellent results in combustion trials, however, the material was eliminated because of the potential of diffusion during storage and possible contamination of propellant grain-to-case chemical bond line systems. Bisphenol A/F, a fluorinated variation of bisphenol A, produced glassy materials at the mass fractions required, and showed repeatable oscillatory combustion. Trifluoroacetic anhydride performed well in combustion trials but proved too reactive in pre-reactions for practical application. Finally, 3,5-bis(trifluoromethyl) aniline showed excellent performance in combustion trials, but at the mass fractions required for 40% metal particulate loadings, the post pre-reaction viscosity exceeded that which is desired for mixing of the remaining ingredients and casting fuel grains. The FHCA's selected for the present investigation showed reasonable reactivity in pre-reactions, acceptable post pre-reaction viscosity, and repeatable combustion characteristics.

Example 3

The decomposition characteristics of the fuel materials were evaluated by way of TGA and DSC analyses. TGA was conducted on a TA Q50 at a temperature ramp rate of 20° C./min. The sample chamber was continuously purged with 99.999% pure nitrogen at a flow rate of 60 m./min. Samples were placed in a tared open aluminum pan, with sample masses averaging approximately 20 mg. DSC analyses were conducted on a TA Q2000 instrument, also at a temperature ramp rate of 20° C./min. The chamber was continuously purged with 99.999% pure nitrogen at a flow rate of 50 ml/min. The DSC sample pans and samples were accurately weighed on a Mettler-Toledo UMT2 scale with sample masses averaging approximately 10 mg. Sample pans were either hermetically sealed aluminum, or aluminum pans with pin-hole lids, depending on the analysis objective.

The direct connect combustion testing was conducted at a heated air facility. The air flow system and air heater were designed to simulate a range of flight conditions up to flight Mach numbers of 3.3 at an altitude of 19.5 km. The bulk air storage consisted of two pressure vessels with a combined capacity of 17 $m^3$ at 16.5 MPa. A TUTCO SureHeat inline heater was able to provide dry air at flow rates up to 0.12 kg/s at a maximum temperature and pressure of 600° C. and 2.1 MPa respectively. The heater temperature was limited to 426° C. to protect the currently installed bypass valve seats. The high-pressure heating elements were powered by a 3-phase, 80 amp, 480 volt control cabinet. Air temperature control was achieved with a remote-controlled process controller using a K-type thermocouple for process-value feedback.

The results of the testing showed that the FHCA improve the C* efficiency by as much as 4 percentage points over a baseline formulation containing 40% aluminum. The TGA and DSC analysis showed that the FHCA were reacted successfully into the polymer matrix and accelerate decomposition out to 360° C. at a rate that correlated to their mass fraction within the formulation. These analyses also showed that the FHCA depolymerized prior to the primary mass loss temperature of the fuel matrix. This indicated that the FHCA was available in the gaseous phase through the boundary layer as the metal particle preheat occurred. Direct connect combustion testing of multiple fuel formulations showed that the C* efficiency was improved over the corresponding baseline formulation. Within the margin of error, the FHCA showed marginal improvement over PTFE. A demonstrated advantage of the FHCA was an improvement of the pressure integral per unit volume of fuel. Of particular interest was the data for the 40% $B_4C$ tests that show the formulations with PTFE slightly lower in C* efficiency as compared to all other cases, to include the baseline.

While several embodiments have been described in detail, it will be apparent to those skilled in the art that the disclosed embodiments may be modified. Therefore, the foregoing description is to be considered exemplary rather than limiting.

What is claimed is:

1. A method of using fluorinated hydroxy functional combustion aids (FHCA) in SFRJ fuels to encapsulate metallic particles within a fluorinated coating to improve exhaust velocity efficiency up to 4 percent, comprising:

pre-reacting hydroxyl functional groups of the FHCA with reagents selected from the group consisting of oxiranes and anhydride curatives, adding the FHCA to SFRJ fuel comprising a polymer matrix to molecularly distribute and immobilize the FHCA in the polymer matrix, the ramjet fuel including metallic particles selected from the group consisting of boron carbide, aluminum particles, and amorphous boron, the FHCA selected from the group consisting of 1,1,1,3,3,3 hexafluoro-2-propanol, 2,2,2 trifluoroethanol, and 3-hydroxybenzotrifluoride;

and encapsulating the metallic particles in the distributed and immobilized FHCA.

2. The method of using FHCA in SFRJ fuel according to claim 1, wherein the metallic particles do not include PTFE.

* * * * *